United States Patent [19]

Lee et al.

[11] 4,147,639

[45] Apr. 3, 1979

[54] LUBRICANT FOR FORMING METALS AT ELEVATED TEMPERATURES

[75] Inventors: D. William Lee, Concord; John L. O'Brien, Winchester; Michael Rossetti, Woburn, all of Mass.

[73] Assignee: Arthur D. Little, Inc., Cambridge, Mass.

[21] Appl. No.: 857,313

[22] Filed: Dec. 5, 1977

Related U.S. Application Data

[63] Continuation-in-part of Ser. No. 660,465, Feb. 23, 1976, abandoned.

[51] Int. Cl.[2] ..... C10M 1/10; C10M 1/06; C10M 3/02; B21B 45/02

[52] U.S. Cl. ..... 252/25; 72/42; 252/49.5

[58] Field of Search ..... 252/25, 49.5; 72/42

[56] References Cited

U.S. PATENT DOCUMENTS

| | | | |
|---|---|---|---|
| 2,469,473 | /1949 | Orozco et al. | 205/21 |
| 3,390,079 | 6/1968 | Utakoji et al. | 252/12 |
| 3,485,753 | 12/1969 | Allais | 252/28 |
| 3,819,521 | 6/1974 | Sims | 252/25 |
| 3,983,042 | 9/1976 | Jain et al. | 252/25 |
| 4,068,513 | 1/1978 | Guerit et al. | 252/25 |

*Primary Examiner*—Delbert E. Gantz
*Assistant Examiner*—Irving Vaughn
*Attorney, Agent, or Firm*—Bessie A. Lepper

[57] ABSTRACT

A lubricant for forming a ferrous metal blank into a preselected configuration by warm- or hot-forming procedures. The lubricant is an alkali-modified borate glass containing a minor mole percent of an alkali metal oxide, preferably sodium oxide. The glass is formed in situ on the surface to be lubricated by depositing on the surface a glass-forming mixture of a source of boron oxide and an alkali metal borate and then heating the mixture to form the glass.

7 Claims, 7 Drawing Figures

LUBRICANT FOR FORMING METALS AT ELEVATED TEMPERATURES

This application is a continuation-in-part of our U.S. Ser. No. 660,465 filed Feb. 23, 1976, now abandoned.

This invention relates to forming metals and more particularly to a lubricant for forming ferrous metals at elevated temperatures to directly produce shaped parts which require little or no additional machining or finishing.

The process of cold-forming has long been used to produce shaped parts such as bushings, couplings and the like. Cold-forming has certain distinct advantages which have made it a desirable technique. Among these advantages are the fact that it embodies cold working of the metal which contributes strength to the finished part and the fact that the cold-formed piece can be used with little or no further machining or surface finishing. Cold-forming does, however, require the expenditure of a large amount of energy and, for all practical purposes, is limited in the size of the blank used and thus in the size of the final cold-formed piece.

Hot-forming, a term which includes hot forging and hot extruding, is a well known procedure for forming mill stock which may be subsequently subjected to further forming, machining and/or surface finishing to obtain the desired configuration. Hot working is usually carried out on a metal which has been heated to a temperature above its recrystallization temperature. As a result of such heating, the crystalline structure of the metal or alloy is altered and its strength may be adversely affected. Since, however, hot-forming requires the expenditure of far less energy in the working step, any sacrifice in strength in the final product may well be tolerated in many instances and may not be experienced in others since the working pressures are low.

Intermediate between these well-known techniques of cold-forming and hot-forming is a procedure which has recently received more attention and which is normally referred to a warm-forming. In some ways, warm-forming is capable of retaining the combined advantages of cold- and hot-forming while minimizing or eliminating their disadvantages. In the warm-forming procedure, the blank to be formed into the desired configuration by die pressing is heated to a temperature below that at which any appreciable recrystallization of the metal will be effected. In the case of ferrous metals and alloys the warm-forming temperature is no greater than about 1500° F. The heating of the blank makes it more easily worked; but since recrystallization does not take place, the working is essentially equal in its physical effects to cold-forming. Thus warm-forming reduces the amount of energy required while retaining the strength after forming associated with the cold-forming of pieces.

Since all of these forming procedures involve metal-to-metal contact under very high pressures and frictional forces, it has been found necessary to provide suitable lubricants to prevent the scoring of the surfaces of both the pieces formed and of the die tooling. The lubricant of this invention is suitable for forming ferrous metals at temperatures between about 1100° F. and 2300° F. Thus it is applicable to both warm- and hot-forming.

In cold-forming the lubricant has generally taken the form of integral coatings on the blanks, such coatings including iron sulfides, phosphates and oxalates. Thermoplastic films have been superimposed upon these integral coatings (see for example U.S. Pat. No. 2,588,234, Re. 24,017). Organic polymers alone have also been used in cold extrusion of mild steels. (See "Polymer Lubricants for the Cold Extrusion of Mild Steel" by D. Blake, et al., *Metallurgia and Metal Forming*, January 1972, pp 30 and 31.) Integral coatings of sulfides and the like require the treatment of the blanks in special atmospheres under carefully controlled conditions and hence their application adds materially to the cost of the cold-forming process. The use of thermoplastic resins as lubricants has distinct advantages for cold-forming; but thermoplastic resins are not applicable for warm-forming because they are thermally degraded at the temperatures used before they can serve as lubricants.

Glass in several different forms has been used as a lubricant in extrusion dies operating at about 2000° F. for making mill stock. These forms of glass include single plates (U.S. Pat. No. 2,539,917), multiple plates (U.S. Pat. No. 3,390,079), a plurality of glass layers (U.S. Pat. No. 3,345,842), plates with glass fibers (U.S. Pat. No. 2,630,220), glass powder with glass fabric (U.S. Pat. No. 3,254,401), finely divided glass in grease (U.S. Pat. No. 3,485,753) and a glass coating adhered to the surface of the blank (U.S. Pat. No. 3,465,424). Glasses, graphite and heavy lubricating oils have been used extensively in hot-forming.

In warm-forming, which has not been used as extensively as cold-forming or hot-extruding, graphite has been used to coat the surfaces of the blank and of the die tooling. However, graphite does not follow the new surfaces generated during forming and hence on those parts undergoing severe forming operations the tooling comes in contact with unlubricated surfaces and is subjected to intolerable wear. Integral coatings of a combination of manganese phosphate and tungsten disulfide have been proposed for warm-forming (see U.S. Pat. No. 3,378,903) but like the use of integral coatings on blanks for cold-forming, this type of lubricant is costly and complicated to apply.

It will therefore be seen that warm-forming of metal parts offers distinct advantages, but there is a need for a suitable, inexpensive lubricant which can make it possible to realize the full potential of the warm-forming process. There is also a need for an improved lubricant for hot-forming.

It is therefore a primary object of this invention to provide an improved process for forming ferrous metals at elevated temperatures. A further object is to provide a process of the character described which makes it possible to form metal configurations at elevated temperatures using less energy than required for cold-forming while retaining essentially all or a major portion of the strength of the metal associated with cold-forming. Another object is to provide a forming process suitable for ferrous alloys which have strengths too high to permit them to be cold-formed. Yet another object is to provide a method of forming ferrous metals at elevated temperatures which makes it possible to handle larger blanks to form larger metal configurations than can be handled with cold-forming. Still a further object is to provide an improved method of die pressing metal parts of such controlled dimension and surface quality that they require little or no further machining or finishing. It is also an object of this invention to provide metal parts with less expenditure of capital costs.

It is another primary object to provide an inexpensive, readily applied coating composition capable of forming in situ a glass which serves as a lubricant for ferrous metals being processed at elevated temperatures. It is another object to provide a lubricant of the character described which may be employed in minimum quantities while at the same time providing maximum protection to the surfaces of the die tooling. Still another object is to provide such a lubricant which is nontoxic and readily removed by washing with water or a mild alkali.

Other objects of the invention will in part be obvious and will in part be apparent hereinafter.

According to one aspect of this invention, there is provided a process for forming a preselected configuration from a ferrous metal blank by die pressing at elevated temperature which includes applying to the surface of the metal blank a coating which is a mixture of a source of boron oxide (selected from $H_3BO_3$ and $B_2O_3$) and an alkali metal borate (preferably sodium tetraborate in the form of borax) and heating the coating to form an alkali-modified glass in situ adhered to the surface as a lubricant. The coating is conveniently applied as a slurry, the liquid vehicle of which is preferably water. The relative amounts of the boron oxide source and alkali metal borate in the mixture are adjusted to provide between about 5 and about 10 mole percent of alkali metal oxide in the glass formed on the surface of the blank whereby the glass has a viscosity ranging between about 500 and 1500 centipoises during the forming operation.

According to another aspect of the invention there is provided a novel composition for applying to a ferrous surface to serve as a precursor for a lubricant during warm- or hot-forming, the composition being a mixture consisting essentially of a source of boron oxide and borate. This mixture may be used in the form of a slurry made with a liquid vehicle. The amounts of boron oxide source and alkali metal borate are adjusted to form a glass which adheres to the surface and which has a viscosity between about 500 and 1500 centipoises under the conditions of formation.

According to yet another aspect of this invention there is provided a novel article of manufacture comprising a ferrous metal blank having adhered thereto a lubricant coating consisting essentially of a mixture of a source of boron oxide and an alkali metal borate, the amount of the alkali metal borate being that which will provide from about 5 to about 10 mole percent of an alkali metal oxide when said coating is heated to form in situ an alkali-modified borate glass adhered to the surface of the ferrous metal blank. The resulting glass provides an effective lubricant when the metal blank is either warm-formed or hot-formed into a preselected configuration.

The invention accordingly comprises the several steps and the relation of one or more of such steps with respect to each of the others, and the composition and article possessing the features, properties, and the relation of constituents, which are exemplified in the following detailed disclosure, and the scope of the invention will be indicated in the claims.

For a fuller understanding of the nature and objects of the invention, reference should be had to the following detailed description taken in connection with the accompanying drawings in which FIG. 1 is a perspective view of an exemplary blank;

Figure 1:
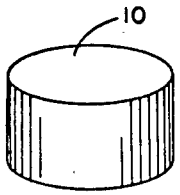

Before describing the formation of the lubricant system of this invention in detail, it will be convenient to briefly describe the general process of forming preselected configurations from blank metal pieces. FIG. 1 illustrates in perspective a ferrous metal blank 10 suitable for the practice of this invention. In back extrusion, the blank 10 with its lubricant surface 11 (FIG. 2) is heated and placed in the die press 12 which, in its simplest form, comprises a closed cylindrical die 13, defining by its internal surface 14 a die cavity 15, and a punch 16 having an external surface 17. Die 12 and punch 16 make up the tooling, and surfaces 14 and 17 are the tooling surfaces which may, if desired, be coated with graphite. As the punch 16 is forced under pressure against the punch-contacting surface 18 of the blank, the metal of the blank is forced backwardly into the volume defined between punch surface 17 and die cavity surface 14 thus forming new metal surfaces 19 and 20. These new surfaces, during their sliding friction fit against the tool surfaces, remain protected by the lubricant, designated by the numeral **11*a* in FIG. 3. The glass lubricant of this invention flows under these conditions and continues to coat the new surfaces as they are formed. At the end of the travel of punch 17 there is formed a configured metal piece 21 shown removed from the die press in FIG. 4. This piece 21 can, for example, be used as a bushing for heavy equipment manufacture by piercing the closed end to open up bore 22**.

Figure 6:
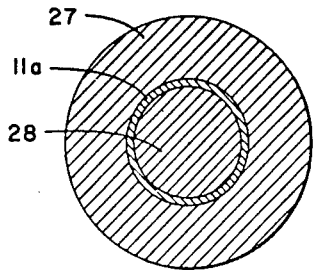
FIG. 6 is a cross section through the die of FIG. 5 taken through plane 6—6 of FIG. 5.
Figure 5:
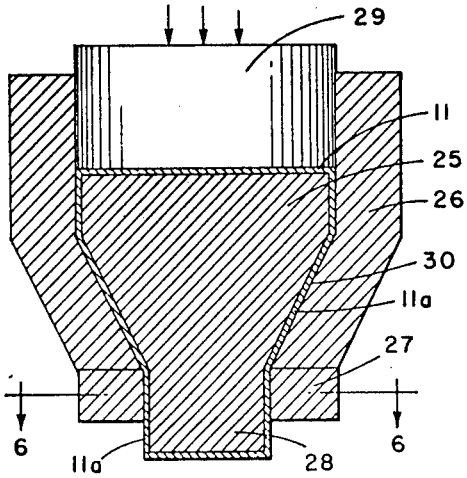
FIG. 5 is a simplified cross section of a die press suitable for forward extrusion showing a configured piece partially formed.

FIG. 5 illustrates the so-called forward extrusion process wherein a blank 25 (configured originally as shown in FIG. 1) is placed in a cavity 26 terminating in an extrusion die 27 with an internal configuration, as shown in FIG. 6, designed to form a circularly configured metal piece 28. As punch 29 is forced against blank 25 a new metal surface 30 forms with lubricant **11*a*** protecting it and keeping the die and part surfaces from being scored.

The lubricant 11 according to this invention is an alkali-modified borate glass formed in situ on the surface of blank 10 by adhering a mixture of a source of boron oxide and an alkali metal borate to the surface and heating it to form the alkali-modified glass. At least a portion of the glass-forming mixture is preferably applied as a slurry, and in this case it is necessary to first remove the liquid vehicle of the slurry. The source of boron oxide is selected from boric acid, $H_3BO_3$, and from boric oxide, $B_2O_3$. The alkali metal borate is preferably a tetraborate, and even more preferable a hydrated tetraborate, e.g., $Na_2B_4O_7$. 10 $H_2O$(borax), $K_2B_4O_7.8\ H_2O$ or $Li_2B_4O_7.5\ H_2O$. Of these, borax is the most economical and the most desirable to use. The hydrated forms of these two components, i.e., boric acid as the source of the boron oxide and borax as the alkali metal borate, are best used when the glass-forming mixture is applied as a slurry in a liquid vehicle; and the water-free forms, i.e., boric oxide and an alkali metal tetraborate (e.g., $Na_2B_4O_7$) are best used when the glass-forming mixture is applied dry.

For convenience, the invention will be further described using boric acid as exemplary of the source of the boron oxide and borax as the alkali metal borate. It will, however, be obvious to those skilled in the art how boric acid and other alkali metal borates may be substituted for these exemplary components used in the following description.

The blank using the lubricant system of this invention is formed of a ferrous metal, a term used to include steels and other alloys. In general, the steels used to form preselected configurations through die pressing are low-carbon steels. However, the lubricant and the forming method of this invention are not limited in their application to low-carbon steels. The metals used need only be capable of being shaped in a die press at temperatures between about 1100° F. and 2300° F.

As noted above when the alkali metal is sodium, the borate used is preferably the sodium tetraborate supplied in the form of borax, $Na_2B_4O_7.10\ H_2O$, because it is inexpensive and readily attainable. Other forms of sodium tetraborate may, of course be used. Commercial grade boric acid, $H_3BO_3$, is suitable for the glass-forming component.

The role of the $Na_2O$ ($K_2O$ or $Li_2O$) in the glass is apparently a multiple one, one of the most important of which is that of controlling the viscosity of the glass during its serving as a lubricant in warm- or hot-forming of the metal on the surface of which it is applied. The glass formed in situ on the metal surface should have a viscosity ranging between about 500 to 1500 centiposes, and preferably about 1000 centipoises at the temperature at which the forming is accomplished. In order to achieve this viscosity range it is necessary to maintain the amount of alkali metal oxide within a specified range; for both below and above this range the glass formed is not satisfactory as a lubricant.

Figure 7:
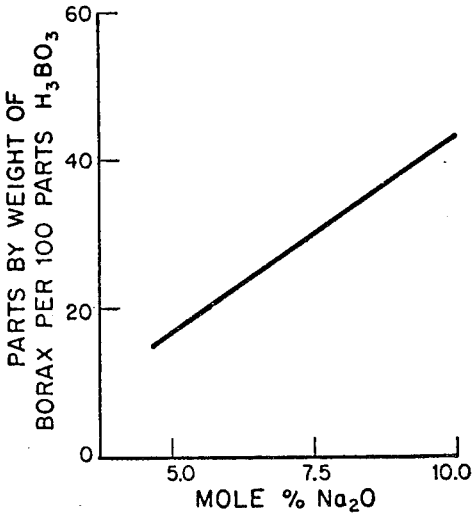
FIG. 7 is a plot of parts by weight of borax per 100 parts by weight of $H_3BO_3$ required to attain the desired mole percent of $Na_2O$ in an exemplary glass lubricant.

A minimum viscosity of the sodium oxide-containing borate glass is attained when about 7 mole percent $Na_2O$ is present. In the practice of this invention the $Na_2O$ content in the glass lubricant formed on the metal surface may range from about 5 to about 10 mole percent to achieve the desired viscosity range. As will be seen from the plot in FIG. 7, when borax is used as the alkali metal borate component, the glass-forming mixture applied to the metal surface may contain between about 15 and about 45 parts by weight for 100 parts by weight of boric acid, $H_3BO_3$, used as the source of boron oxide. On a weight percentage basis, this means that the mixture of borax and boric acid may contain between about 13 and about 31% by weight borax. Suitable weight ratios for other forms of sodium tetraborate may readily be calculated as well as for the alkali metal borates and for the use of boric acid as the source of boron oxide.

It is important in providing a glass lubricant for metal forming that it be nontoxic to handle and readily removable without introducing any pollution problems. Both of these desiderata are attained by the liquid coating composition of this invention without the introduction of such toxic, viscosity controlling oxides as lead oxide. The residual glass on the metal surface after formation may be washed down the drain with water or a mild alkali.

It also appears that another role of the sodium oxide, or other alkali metal oxide, in the glass lubricant is that of a solvent for iron oxides which may be present on the surface of the blank. The dissolving of these iron oxides may contribute to the good adhesion of the glass to the metal surface. Finally, the presence of a small amount of sodium tetraborate, or other alkali metal borate, increases the solubility of boric acid in water.

As noted above, there is a large body of art on the use of a number of different preformed glasses in various forms (e.g., coatings, one or more plates, one or more layers, fibers, powders and the like) as lubricants. In contrast to this, by the process of this invention the necessity to preform the glass is eliminated and its in situ formation of the alkali-modified glass can be made a part of the heating cycle required in the warm- or hot-forming procedure. Moreover, the glass-forming mixture applied consists of but two components—typically, sodium tetraborate preferably in the form of borax, and boric acid.

The mixture of these glass-forming components is preferably applied as a slurry. Although the liquid vehicle of the slurry may be such liquids as alcohols (e.g., ethyl alcohol), ketones and the like, water is preferred. This liquid vehicle serves no lubricating function. Both borax and boric acid are soluble to a limited extent in water. However, the coating composition of this invention should be made up as a slurry containing preferably from about 100 to 200 parts by weight of the borax/boric acid mixture for every 100 parts by weight of the liquid vehicle, This is, of course, equivalent to a slurry having from about 50 to about 70% solids concentration.

The slurry forming the coating composition of this invention can be applied to the surface of the blank by any well-known technique including, but not limited to, spraying, dipping, painting and the like. The thickness of the coating of the mixture of alkali metal borate and source of boron oxide applied to the metal blank surface would be that which will form a glass layer ranging in thickness between about 1 and about 5 mils.

Before forming the glass in situ on the metal surface it is necessary to remove the liquid vehicle if a slurry is used, and this is conveniently done by heating. A preferred way of accomplishing this is to apply the sodium tetraborate/boric acid slurry to the surface of the blank after it has been heated to about 300° F. thus vaporizing off the liquid medium as the slurry is applied.

Under some circumstances, it may not be convenient to handle and apply a relatively thick slurry, e.g., one having a solids concentration within the upper range specified. Slurries of this nature can be difficult to pump and to apply as a uniform coating. In such cases, it is possible to apply an undercoating of a relatively thin slurry, e.g., one having a solids concentration of no greater than about 60%, and once it has been applied to add, in dry powder form, whatever remaining quantity of glass components may be required to attain the final desired glass lubricant thickness. This added dry powder may, for example, be a dry mixture of boric acid and anhydrous sodium tetraborate or a dry glass frit of essentially the same composition as the glass formed in situ. Such a dry powder may be applied immediately after the slurry coating is put on, or it may be applied as the glass is being formed by the heating of the mixture of boric acid and sodium tetraborate in the undercoating. When such powder is deposited onto a wet slurry undercoating, it forms a homogeneous glass in situ with the solids mixture applied in the slurry; and when the powder is deposited onto a glass coating already formed from the deposition of the solids mixture slurry, it blends into the glass to form a homogeneous lubricant. In the latter case, it is preferable to apply the dry powder while the blank is heated and the first glass coating is tacky or in a liquid condition.

Any suitable known procedure for depositing solids onto a surface may be used to apply the solids dry mixture of boric acid and anhydrous sodium tetraborate in this embodiment of the process of this invention. Exemplary of such a procedure is the spraying of the solids in an air stream.

Once the glass-forming mixture is affixed to the metal surface the blank is heated to a temperature between about 1200° F. and 1400° F. to form an alkali-modified glass, e.g., $B_2O_3/Na_2O$, lubricant in situ. The resulting lubricant-coated blank can then be formed into a preselected configuration by the technique of warm-forming or hot-forming described above. The lubricant of this invention is effective in forming ferrous metals at temperatures between about 1100° F. and 2300° F.

In a preferred process according to this invention, the steps of applying the coating composition, forming of the glass lubricant in situ and warm- or hot-forming of the metal are carried out in essentially immediate succession so that the energy requirements for developing the necessary elevated temperatures are maintained at a minimum. It is also, however, within the scope of this invention to cool the metal blank between each of these steps since both the glass-forming coating mixture and glass coating exhibit good adherence to the metal surface.

Subsequent to the forming of the metal, the glass lubricant may be removed by washing in water or in a mild alkaline solution such as a dilute aqueous solution of sodium hydroxide. This use of a sodium hydroxide solution is preferred in those cases where $Na_2O$ is present in the glass in the higher ranges.

The process, article of manufacture and composition of matter are further illustrated by the following example which is meant to be illustrative but not limiting.

A coating composition was formed by making a slurry of 175 grams of boric acid powder, 50 grams of borax powder and 175 cc of water. The slurry had a pH of 7 and was of a consistency which permitted it to be sprayed onto the surfaces of a ferrous metal blank. This coating composition was chosen to result in a glass composition after firing containing 7 mole percent of $Na_2O$.

The blank used was a cylindrically shaped steel slug having a diameter of about six inches and length of about eight inches. When the blank had been preheated to 350° F. the coating slurry was sprayed over the entire surface of it with a commercially available paint sprayer. The water, serving as the liquid vehicle of the slurry, was evaporated during the application of the slurry to the preheated blank so that the coating formed on its surface was an essentially dry mixture of the boric acid and sodium tetraborate adhering tightly to the surface. The thickness of the coating thus applied ranged between about one and two mils.

Immediately subsequent to the formation of the dry coating on the blank and while it was still at about 350° F., it was placed into an induction coil to be heated to about 1400° F. to form the glass lubricant in situ on its surface. This heating of the blank required about eight minutes to fire the coating and to bring the blank up to temperature for warm forming. When the blank was removed from the induction coil it was observed that the glass lubricant coating had a thick syrup consistency and was uniformly adhered to the surface.

Figure 4:
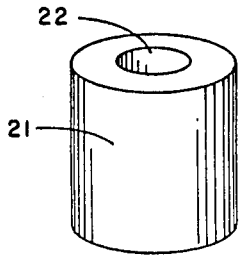
FIG. 4 is a perspective view of the configured piece formed.
Figure 2:
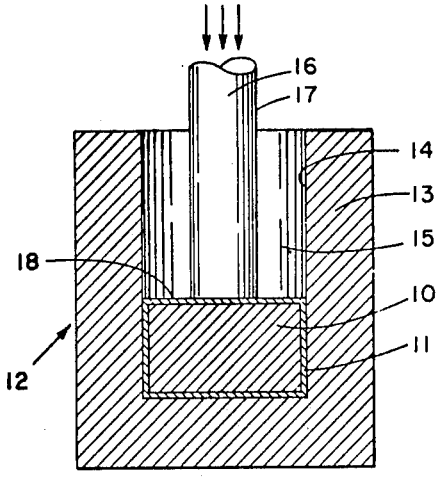
FIG. 2 is a simplified cross section of a die press suitable for back extrusion showing a blank in position.
Figure 3:
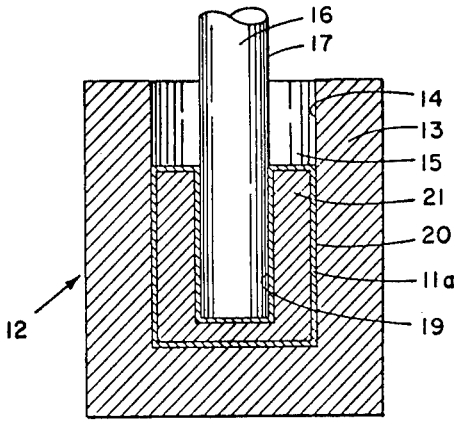
FIG. 3 is the die press of FIG. 2 showing the formation of a configured ferrous metal part.

Immediately, without further heating, the lubricant-coated blank was transferred to a die press similar to that illustrated in FIGS. 2 and 3 for back extrusion to form a configuration similar to that illustrated in FIG. 4. It was not found necessary to coat the punch and die surfaces with graphite prior to back extruding the slug. Upon completion of the pressing operation the finished shaped steel piece was removed from the die and the punch was withdrawn. The glass lubricant was washed off with a dilute alkali solution. The surfaces of the finished steel piece were relatively smooth with no apparent scoring. The surfaces of the punch and die likewise remained free of scratching.

A control run was also made in which the lubricant of this invention was replaced by a graphite coating and back extruding was carried out as described. The results of such a control run served as a basis for evaluating the performance of the lubricant of this invention.

From a number of repetitions of this example and of the control run it was determined that the forming load (pressure) required for warm forming using the lubricant of this invention was from 5 to 15% less than that required when graphite was used on the blank surface as a lubricant. When graphite was used as the lubricant on the blank surface it was necessary to spray the punch and die surfaces also with graphite. This was not the case for the lubricant of this invention. The knockout of the parts, as determined from press noise, was found to be easier for the parts coated with glass in accordance with this invention than for those coated with graphite.

The lubricant of this invention is particularly suitable for use in warm-forming ferrous metals, e.g., low carbon steels, high alloy steels, and other ferrous metals. The importance of the realization of reliable warm-forming may be illustrated by pointing out that it makes possible the fabrication of very large low carbon steel parts heretofore only attainable by such techniques as machining and casting—techniques which are prohibitive in cost for most applications. Moreover, warm-forming makes it possible to work high alloy steels.

It will thus be seen that the objects set forth above, among those made apparent from the preceding description, are efficiently attained and, since certian changes may be made in carrying out the above process and in the article set forth without departing from the scope of the invention, it is intended that all matter contained in the above description or shown in the accompanying drawings shall be interpreted as illustrative and not in a limiting sense.

We claim:

1. A liquid coating composition for applying to a ferrous surface to serve as the precursor of a lubricant to be used during forming under pressure at an elevated temperature between about 1100° F. and 2300° F., characterized as being a slurry of a mixture consisting essentially of a source of boron oxide selected from the group consisting of boric acid and boric oxide and an alkali metal borate in a liquid vehicle which serves no lubricating function, said alkali metal borate being present in said mixture in an amount to provide between about 5 and about 10 mole percent of alkali metal oxide when said mixture is heated to form therefrom an alkali-modified borate glass which has a viscosity ranging between about 500 and about 1500 centipoises at said elevated temperature.

2. A liquid coating composition in accordance with claim 1 further characterized as having a pH of about 7.

3. A liquid coating composition in accordance with claim 1 wherein said liquid vehicle is water.

4. A liquid coating composition in accordance with claim 1 wherein said source of boron oxide is boric acid and said alkali metal borate is sodium tetraborate provided in the form of borax.

5. A liquid coating composition in accordance with claim 4 wherein said sodium tetraborate is present in said mixture in an amount to provide about 7.5 mole percent of sodium oxide.

6. A liquid coating composition in accordance with claim 1 wherein said slurry has a solids concentration between about 50 and about 70 weight percent.

7. A liquid coating composition in accordance with claim 1 consisting essentially of about 175 parts by weight boric acid powder, about 50 parts by weight borax powder and about 175 parts by weight water.

* * * * *